United States Patent [19]

Cordes

[11] Patent Number: 4,559,860

[45] Date of Patent: Dec. 24, 1985

[54] DRUM BRUSH

[76] Inventor: Charles Cordes, 27 Kenneth Pl., Clark, N.J. 07066

[21] Appl. No.: 709,248

[22] Filed: Mar. 7, 1985

[51] Int. Cl.[4] ..... G10D 13/02
[52] U.S. Cl. ..... 84/422 S
[58] Field of Search ..... 84/422 S

[56] References Cited

U.S. PATENT DOCUMENTS

| | | | |
|---|---|---|---|
| 3,150,555 | 9/1964 | Sage | 84/422 S |
| 3,420,134 | 1/1969 | Cordes | 84/422 S |
| 4,028,983 | 6/1977 | Calato | 84/422 S |
| 4,200,026 | 4/1980 | Phreaner | 84/422 S |

*Primary Examiner*—Lawrence R. Franklin
*Attorney, Agent, or Firm*—Sughrue, Mion, Zinn, Macpeak and Seas

[57] ABSTRACT

A drum brush having a hollow tubular handle is provided with a plurality of coiled wire filaments of equal lengths slidably mounted therein. The ends of the coiled wire filaments within the hollow tubular handle are disposed in close intermeshing engagement with each other and are secured together in a manner to prevent withdrawal of the filaments from the handle. The hollow tubular handle is provided with an oval-shaped opening for varying the spread of the coiled wire filaments upon extension and retraction of the filaments relative to the hollow tubular handle.

5 Claims, 4 Drawing Figures

10
11
12
14
16
18
19
20
22
3.

DRUM BRUSH

BACKGROUND OF THE INVENTION

Prior art snare drum brushes have traditionally been made of a plurality of fine wire filaments which may be extended from or retracted into a hollow elongated handle member. Such a construction presented numerous drawbacks, the primary one being the fragile wire filaments per se. A drummer had to be extremely careful with these prior art filaments, both in the handling of them while playing, and also in the storage of brushes, since the fine metal wires were very susceptible to bending. Once the filaments became bent, twisted, or broken, they were apt to become jammed within the tubular handle member or would stick out at unusual angles from the main body of filaments where they were susceptible to being snagged on objects, such as the edge of the drum, thereby hindering the drummer in their proper use. Once a wire filament kinks, it is impossible to straighted it out to its former condition, and it is necessary to cut it off, thereby leaving a sharp, stiff, piercing strand.

Another drawback in the use of fine wire filaments for drumbrushes resides in the fact that the wire filaments in use tend to wear a sharp end or point. This sharp point finds the minute holes in natural skin drum heads, thereby causing a break in the drum skin, or at least making the holes larger.

Applicant's prior U.S. Pat. No. 3,420,134, granted Jan. 7, 1969, discloses a snare drum brush having filaments constructed of plastic material having a relatively large diameter as compared to the diameter of conventional metal wire filaments. By constructing the filaments of relatively large diameter plastics material, the filaments do not have any tendency to kink or bend, and do not tend to catch in the holes in a natural skin drum head. While the use of plastic filaments achieves a sharper sound on the drum and a more brilliant sound on the cymbal than the conventional brush constructed from fine wire filaments, many drummers resisted the use of the unconventional plastic filaments and still preferred to use the brushes having fine metal wire filaments in spite of the drawbacks associated therewith.

SUMMARY OF THE INVENTION

The present invention provides a new and improved drum brush which utilizes metal wire filaments but overcomes all of the aforementioned drawbacks associated with brushes utilizing fine metallic wire filaments while providing a unique improved sound.

The present invention provides a new and improved drum brush comprising a hollow cylindrical handle member having an oval shaped opening at one end thereof, a plurality of coiled wire filaments of substantially equal length as well as uniform diameter and pitch slidably mounted longitudinally in said handle and protruding from said oval shaped end and means for securing the ends of the filaments together which are disposed internally of said handle.

Other features and advantages of the invention will be pointed out in the following description and claims and illustrated in the accompanying drawings which disclose by way of example, the principles of the present invention in the best mode which has been contemplated for applying those principles.

IN THE DRAWINGS

DETAILED DESCRIPTION OF THE INVENTION

Figures 1, 2, 3, 4:
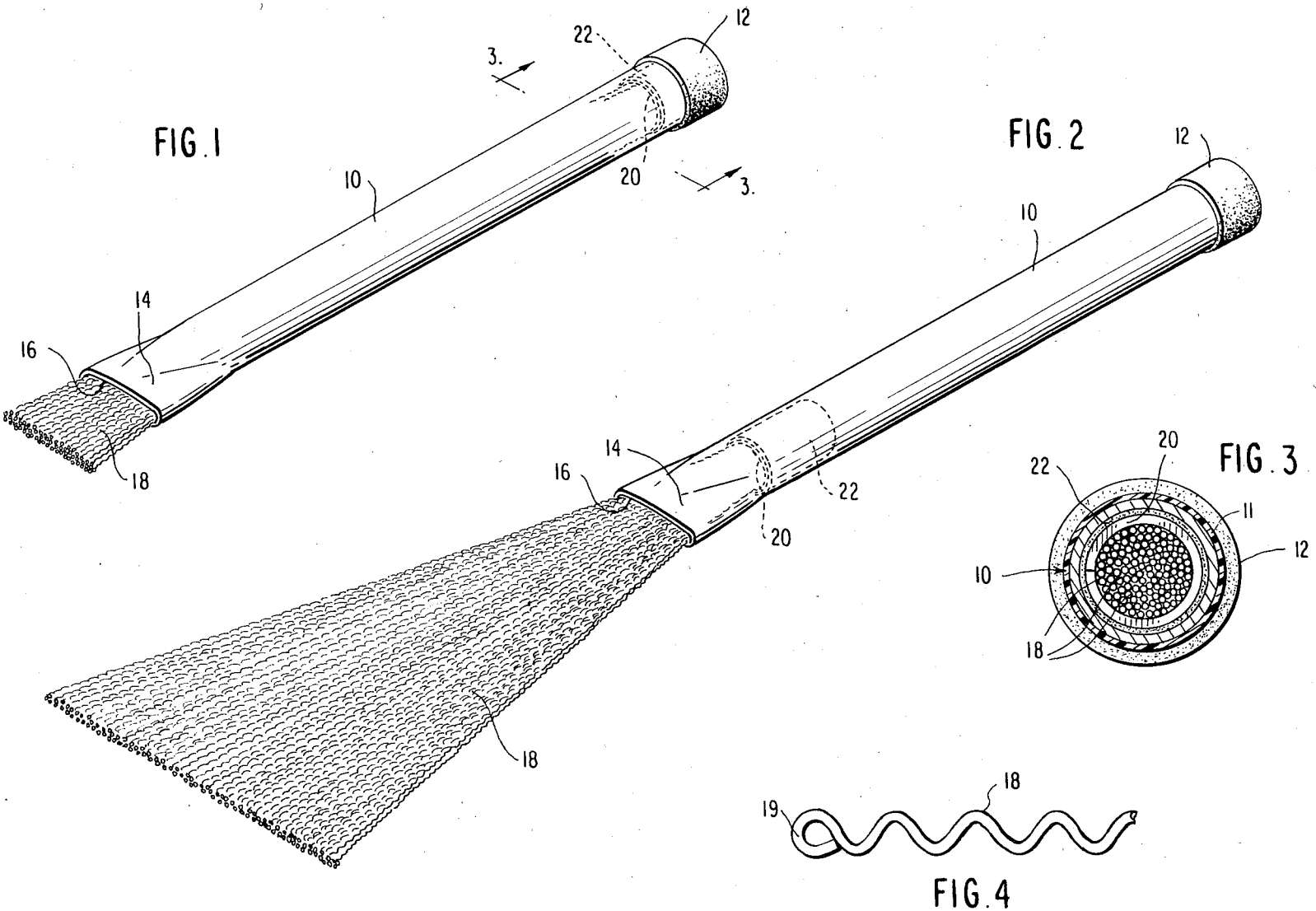
FIG. 1 is a perspective view of the drum brush with the coiled wire filaments retracted within the handle structure.
FIG. 2 is a perspective view of the drum brush with the coiled wire filaments in their extended position.
FIG. 3 is a sectional view taken along the line 3—3 of FIG. 1.
FIG. 4 is an enlarged view of an exposed end portion of a single coiled wire filament.

Turning now to the specific construction of the snare drum brush, an elongated hollow cylindrical handle member 10 is formed of any suitable rigid material of metal or plastics. According to a preferred construction, the handle member is formed from one-half inch internal diameter aluminum tubing approximately seven inches long and having a vinyl cover 11 one-sixteenth of an inch thick disposed thereon either by blowing or heat shrinking. A plastic cap member 12 having a five-eighths inch internal diameter is provided to close one end of the hollow handle member 10. While a simple friction fit is usually sufficient to secure the cap member 12 on the vinyl covered handle 10, it is comtemplated that any other type of connection, such as a screw connection, a snap connection, or the like, may be utilized. The opposite end of the handle 10 is partially flattened at 14 to provide a substantially oval opening 16.

A plurality of coiled wire filaments 18 are disposed within the handle 10 and protrude outwardly of the handle through the oval shaped opening 16. The number of coiled wire filaments 18 employed in a particular brush construction is sufficient to fill the oval shaped opening 16, as best shown in FIGS. 1 and 2. The coiled wire filaments 18 are substantially equal in length with the ends of the coiled wire filaments disposed within the handle being in close intermeshed relation. A split ring 20 of soft aluminum is crimped about the ends of the coiled wire filaments 18 within the handle and the sleeve 22 of plastics material is closely fitted over the aluminum split ring 20 to prevent rattling within the handle 10 and to provide a close sliding fit within the handle 10 which will provide a slight drag upon movement of the coiled wire filaments into and out of the handle 10. The coiled wire filaments 18 are slightly longer than the hollow tubular handle 10 so that upon retraction of the coiled wire filaments 18 into the handle, the plastic sleeve 22 will abut the cap 12, while a short portion of the filaments will extend outwardly beyond the oval shaped opening 16 to enable the user to grasp the filaments and pull them outwardly to the desired position. The frictional drag of the plastic sleeve within the handle plus the click-stop effect provided by the engagement of the individual coiled wires with the lip of the oval shaped opening 16, serve to hold the filaments at any desired intermediate position. The provision of the aluminum split ring 20 and the plastic sleeve 22 prevent the complete withdrawal of the filaments 18 from the hollow tubular handle 10. In addition to the aluminum split ring 20, it is desirable to provide an epoxy resin to secure the innermost ends of the coiled wire filaments to each other to prevent the extraction of individual filaments from the bundle. While the intermeshing of the individual coiled filaments prevent the direct extraction of the filaments, it would be possible to remove individual filaments by a screwing action without the use of such an epoxy resin.

Each individual coiled wire filament 18 is manufactured from heat treated spring steel-type wire having a diameter of 0.020 inches. The wire is formed into a coil having an outer diameter of 0.070–0.075 inches and a one-eighth inch pitch. Such a coiled wire filament is very hard and is resistent to bending. Since the coiled wire filament 18 of the present invention does not flex as easily as the straight wire filaments of prior art brushes, the individual coiled wire filaments are stiffer and provided a more positive action on the drum head or cymbals. The use of the coiled wire filaments 18 provides a louder, penetrating sound with a very brilliant high pitch. Since each of the filaments are coiled, the degree of contact is significantly different from that provided by the prior art straight wire brushes. The fact that the filaments are coiled provides an interrupted contact with the drum head as opposed to the flat contact of the prior art straight brushes. Thus, the ends of the wires do not tend to be worn down to a sharp point, and a clicking sound can be obtained by passing the individual coils over the edge of a cymbal. The outer end of each coiled wire 18 is bent back upon itself to form a closed loop 19 as shown in FIG. 4. Since the ends of each filament do not protrude directly outwardly as with straight wire filaments, the possibilities of having the sharp wire ends catch in imperfections on the drum head surface, catch on the wire ends of second brush, or pierce the fingers of the user are eliminated.

In lieu of the aluminum split ring 10 and plastic sleeve 22, the numerous ends of the coiled wires may be secured together by two steel wires (not shown), which are wound about the bundle of coiled wires in spaced relation to each other within the handle 10. The securing wires may be of substantially the same gauge as the coiled wires 18 with each wire wrapped about the bundle approximately one and one half turns. Since the securing wires will lie within the coils of the individual coiled wires, the diameter of the bundle within the handle 10 will not be increased. To prevent the innermost end of the bundle from rattling against the tubular handle 10 a plastic sleeve similar to sleeve 22 may be used or an excess of the epoxy resin which secures the wires 18 together can be molded to form an enlarged diameter end portion which will slide quietly with the tubular handle 10.

In summary, the unique drum brush according to the present invention is extremely long wearing and resistent to bending while producing a brighter, more responsive, and stronger sound than straight wire brushes. While the invention has been particularly shown and described with reference to a preferred embodiment thereof, it will be understood by those skilled in the art, that various changes in form and details may be made therein without departing from the spirit and scope of the invention.

What is claimed is;

1. A drum brush comprising a hollow cylindrical handle member having one end thereof provided with a substantially oval-shaped opening, a plurality of coiled wire filaments of substantially equal length each having one end thereof extending into said hollow handle through said oval shaped opening and means for holding the ends of said filaments together within said hollow handle to prevent complete withdrawal of said filaments through said opening.

2. A brush as set forth in claim 1 wherein the number of said filaments is such as to completely fill the substantially oval-shaped opening to provide a friction fit.

3. A brush as set forth in claim 2 wherein said means for holding said filaments together is comprised of an epoxy resin in combination with securing means fastened about the ends of said filaments.

4. A brush as set forth in claim 1 wherein said coiled wire filaments are formed from heat treated spring steel wire with each of said coiled wire filaments having a uniform diameter and length.

5. A brush as set forth in claim 1 wherein the opposite end of each coiled wire filament is bent back upon itself to define a closed loop.

* * * * *